United States Patent [19]

Grobman

[11] 4,043,265

[45] Aug. 23, 1977

[54] INK LEVEL WARNING SYSTEM

[75] Inventor: William Grobman, Philadelphia, Pa.

[73] Assignee: Molins Macine Company, Inc., Camden, N.J.

[21] Appl. No.: 653,417

[22] Filed: Jan. 29, 1976

[51] Int. Cl.[2] ..... B41F 31/06

[52] U.S. Cl. ..... 101/350; 101/363

[58] Field of Search ..... 101/348, 349, 350, 351, 101/352, 363, 364, 365, 207–210; 241/32, 34, 35, 222; 118/7

[56] References Cited

U.S. PATENT DOCUMENTS

| | | | |
|---|---|---|---|
| 1,742,434 | 1/1930 | Costello | 241/35 |
| 3,283,712 | 11/1966 | Chambon | 101/350 |
| 3,442,121 | 5/1969 | Wirz | 73/150 |
| 3,769,909 | 11/1973 | Fugman | 101/363 X |
| 3,926,114 | 12/1975 | Matuschke | 101/350 |

*Primary Examiner*—J. Reed Fisher

*Attorney, Agent, or Firm*—Seidel, Gonda & Goldhammer

[57] ABSTRACT

A flexographic printer is provided with apparatus for sensing the level of ink in a trough between a transfer roll and a metering roll and for triggering an alarm when such ink level is below a predetermined amount.

10 Claims, 4 Drawing Figures

FIG. 3
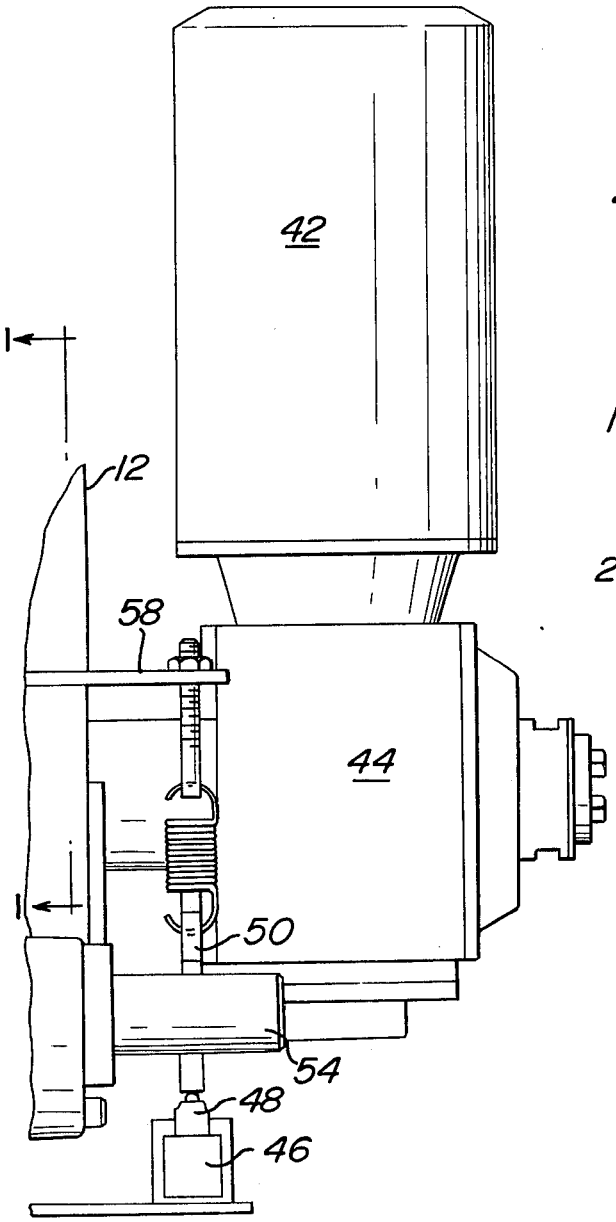
FIG. 1
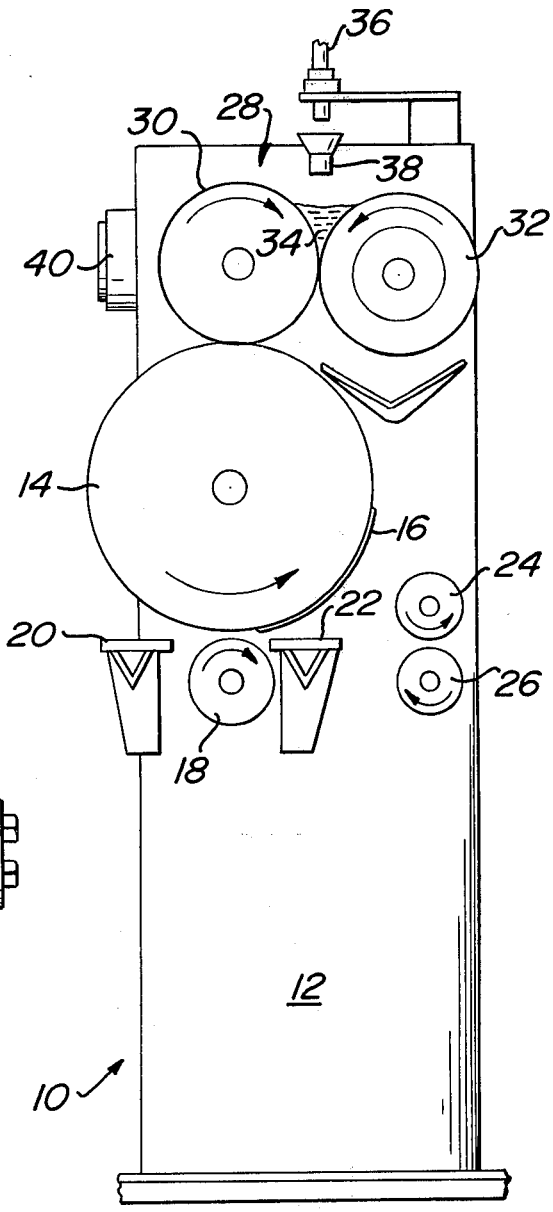
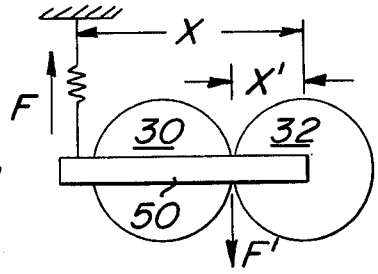
FIG. 4

INK LEVEL WARNING SYSTEM

BACKGROUND

A flexographic printing process conventionally employs rollers to distribute a water-soluable ink to the printing dies. The ink is introduced into a fountain formed by the trough between two parallel touching rollers. Conventionally, the surface of one of the rollers is finely engraved for transferring the ink to a printing die. The mating roller of said pair of rollers is a rubber or plastic covered roller so that pressure may be exerted against the engraved surface to remove surplus ink.

It is highly important that there always be ink in a sufficient quantity in the fountain to maintain lubrication between the rollers while the rollers are rotating. If no ink were present in any part of the fountain between the rollers, the different surface speeds of the rollers would cause rapid abrasion of the rubber or plastic surface on the metering roller and ultimately damage to the surface of the engraved roller.

One use of a flexographic printing apparatus is the printing of sheets of corrugated paperboard in the manufacture of cartons. Printing presses for such manufacture usually include other operations such as scoring, slotting, and die cutting, all of which generate undesirable dust. To keep the printing rollers clean and prevent contamination of the ink, the printing section of the press is shrouded. Such shrouding prevents the introduction of dust but also prevents the operator from observing the printing rollers for determination that sufficient ink is present.

Conventionally, the ink is pumped to the ink fountain from a supply pail. Should the ink supply diminish below a predetermined amount, the operator may not be aware of the same until notice is taken of the off-color of ink on the sheets of paperboard. Then, the press is stopped to permit immediate replenishment of the ink supply. If only a narrow small printing die is in use, the ends of the rollers can be dry and without ink whereby the rollers may be damaged.

There is a need for a simple means to warn the operator that the ink level in the ink fountain is too low. The ink level cannot readily be measured with a float because the depth of the ink is shallow and there is a danger that the float will be drawn into the nip of the rollers. Other liquid level sensing devices have been tried but have not been found to be satisfactory.

This invention relates to apparatus including a transfer roll and a metering roll. The rolls cooperate to define a trough therebetween along the length thereof for receiving a liquid printing medium such as flexographic ink. Motor means are provided for rotating said rolls about their longitudinal axes but in opposite directions. The printing medium acts also as a lubricant between contacting peripheral portions of said rolls.

An alarm means is provided together with a means for triggering the alarm means in response to the reaction torque of the motor drive means on the metering roll. The alarm means is triggered when the lubricity of printing medium in said trough is below a predetermined level.

In the preferred embodiment of the present invention, the level of printing medium such as ink is not measured directly but is sensed by a means which responds to a condition of rotation of the metering roll. When the ink is the trough is below a predetermined level, the ink no longer functions as a lubricant along the entire length of the metering roll and transfer roll. Then, since the two rolls are independently driven and the transfer roll conventionally has a higher surface speed, the increased friction affects the torque required to drive the metering roll. The transfer roll then tends to drive the metering roll. This change in the torque applied to the metering roll is sensed and an alarm is triggered.

It is an object of the present invention to provide a simple warning apparatus to alert a printing press operator that the ink level in the fountain is too low.

It is another object of the present invention to provide apparatus by which a printing press can be caused to automatically stop before fountain rolls are damaged as a result of an insufficient supply of ink.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a diagrammatic side elevation view of a flexographic printing apparatus.

FIG. 3 is a side view taken along the line 3—3 in FIG. 2.

FIG. 4 is a schematic vector diagram.

Referring to the drawing in detail, wherein like numerals indicate like elements, there is shown in FIG. 1 an apparatus in the form of a printing section in accordance with the present invention and designated generally as 10.

Figure 2:
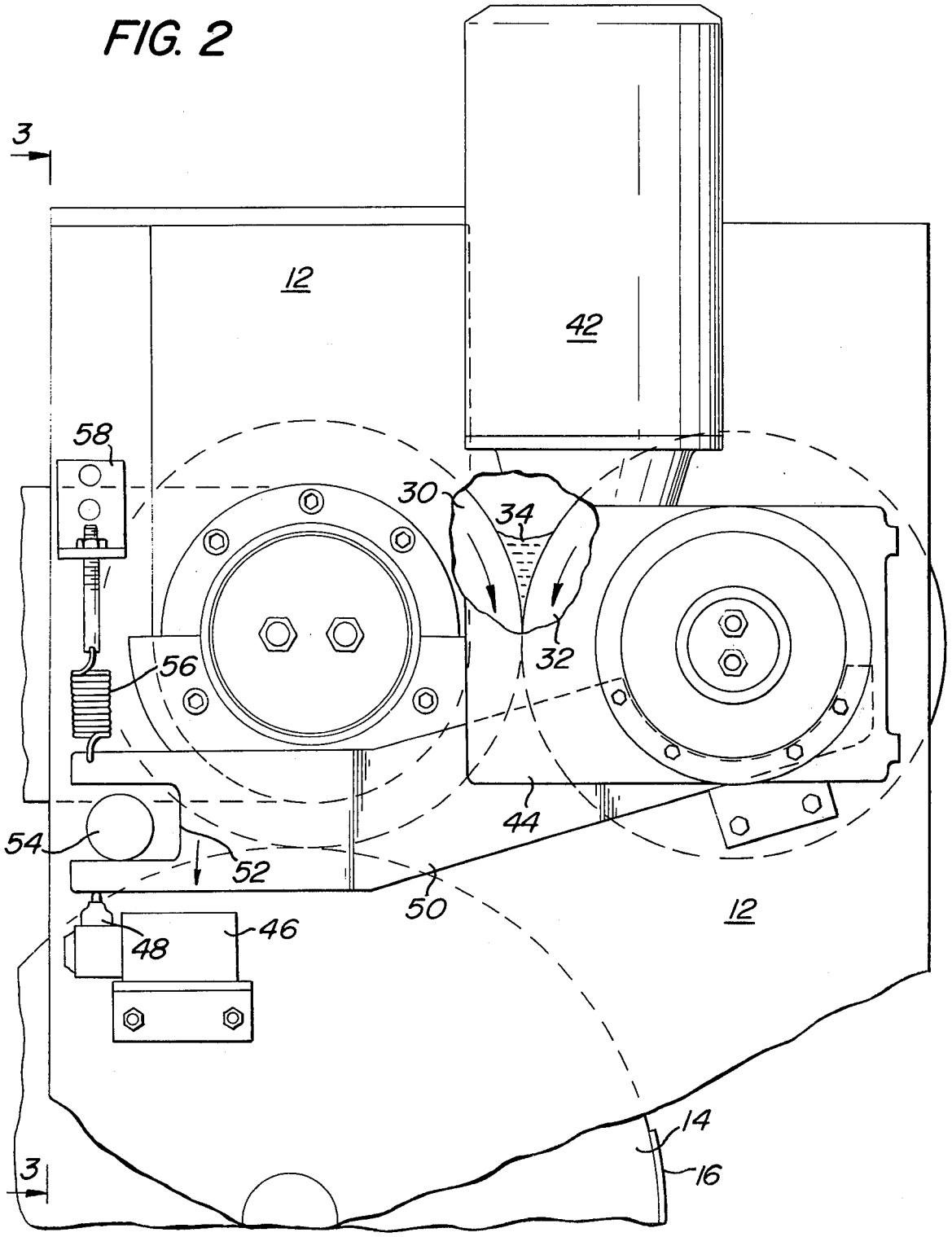
FIG. 2 is an englarged view of the details shown at the upper end of FIG. 1.

The apparatus 10 includes spaced side frames 12 which support a horizontally disposed print cylinder 14 which is driven in a conventional manner. The print cylinder 14 is provided with a die plate 16 thereon for printing on a web or sheet as the same moves from left to right in FIG. 1 between the print cylinder and the anvil 18. The web or sheet, while it is being printed, is supported from below by supports 20 and 22 and is moved from left to right in FIG. 1 by the feed rolls 24, 26.

The apparatus 10 includes an ink fountain designated generally as 28. The fountain 28 includes a transfer roll 30 which is parallel to the print cylinder 14 and in contact with die plate 16. A metering roll 32 is parallel to the transfer roll 30 and in contact therewith. The metering roll 30 and transfer roll 32 are alongside one another so as to form a trough for retaining a supply of ink 34. The ink 34 acts as a lubricant between the rolls 30 and 32. Ink is supplied under pump pressure from a pail through conduit 36 to the nozzle or funnel 38 disposed approximately equidistant from the ends of the rolls 30 and 32. No attempt is made to accurately and completely show the supply system for delivering ink to the fountain 28 and removing excess ink therefrom.

As shown more clearly in FIG. 2, the rolls 30 and 32 rotate in opposite directions. Roll 30 is illustrated as rotating in a clockwise direction while roll 32 is illustrated as rotating in a counterclockwise direction. Roll 30 is synchronously driven with printer cylinder 14 by a motor designated 40. In an actual printer slotter, the motor 40 will be located in position spaced from the location illustrated in FIG. 1. Rolls 14 and 30 have the same surface speed which is greater than the surface speed of roll 32. Roll 32 is driven by a motor 42 by way of conventional speed reducer within housing 44.

Motor 42 is physically bolted to and supported by the housing 44.

The motor 42 is vertically disposed and for purposes of illustration is not directly above the center of roll 32. The output shaft of motor 42 is coupled by way of conventional speed reducing gears to a journal on roll 32. The housing 44 enclosing the speed reducing gears comprises a shaft-mounted speed reducer. Motor 42, housing 44 and the journal on shaft 32 are per se old in the art.

The transfer roll 30 generally has an engraved or etched outer peripheral surface to retain ink and transfer ink from the ink supply 34 to the die plate 16 on the print cylinder 14. Ceramic surfaced transfer rolls may also be used. The metering roll 32 meters the ink on the periphery of transfer roll 30 which may be transferred to the die plate 16. The peripheral surface of the metering roll 32 is preferably a flexible or resilient material such as rubber or other polymeric plastic for squeegeeing surplus ink from the surface of the transfer roll.

An alarm 46 which may be audible or visual, is supported on the frame 12 and is provided with an actuator switch 48. A means is provided for triggering the alarm to indicate that the level of the ink supply 34 is dangerously low or non-existent. The alarm is triggered by rotation of the motor 42 and housing 44 about the longitudinal axis of roll 32. In this regard, it will be noted that the motor 42 and housing 34 are not directly supported in a fixed manner on the frame 12. The triggering means includes arm 50 having one end bolted or otherwise fixed to the housing 44. It is to be noted that the switch 48 may also be connected to the machine drive to stop the apparatus 10 if preferred.

The other end of arm 50 is preferably bifurcated to provide an opening or fork 52. The lower end of the fork 52 is in contact with a stud 54 fixed to the frame 12. Tension spring 56 has one end connected to arm 50. The other end of spring 56 is adjustably connected to a bracket 58 on the frame 12. Spring 56 biases arm 50 in a clockwise direction in FIG. 2 so as to maintain the bottom of the fork 52 in contact with the stud 54 and spaced from the switch 48 thereby counterbalancing any weight vector of motor 42 about the axis of roll 32 and also counterbalancing any normal reaction torque of roll 32.

The apparatus 10 operates in conventioanl manner to print webs or sheets except as will be made clear hereinafter. Spring 56 maintains arm 50, housing 44 and motor 42 in the position illustrated so long as ink supply 34 acts as a lubricant between rolls 30, 32. When ink supply 34 is depleted, the surface speed of metering roll 32 is increased by contact with transfer roll 30. Since roll 32 now rotates faster, there is a reaction torque (F'X') in a counterclockwise direction on motor 42 and housing 44 in FIG. 2.

When the reaction torque (F'X') on motor 42 and housing 44 exceeds the moment (FX) of spring 56, arm 50 triggers the alarm by closing switch 48. The extent of pivotal movement of arm 50, motor 42 and housing 44 is limited by stud 54. As soon as a new ink supply 34 is established along the length of rolls 30, 32, the ink again acts as a lubricant between rolls 30, 32, whereby spring 56 automatically repositions arm 50 in the position shown in FIG. 2.

Exemplary data for the diagram in FIG. 4 is as follows: spring 56 is an 11 lb. spring, the distance X is 13 inches, and the distance X' is 4 inches. These figures may vary so long as FX is greater than F'X' during normal operation.

It will be noted that the means for triggering the alarm 46 responds to a condition of rotation of the metering roll 32 such as the torque requirements. Other equivalent alarm triggering means responsive to rotation of the metering roll 32 will be apparent to those skilled in the art.

The present invention may be embodied in other specific forms without departing from the spirit or essential attributes thereof and, accordingly, reference should be made to the appended claims, rather than to the foregoing specification as indicating the scope of the invention.

What is claimed is:

1. Apparatus comprising a transfer roll, a metering roll generally parallel to said transfer roll and cooperating therewith to define a trough therebetween along the length thereof for receiving a liquid printing medium which acts as a lubricant between contacting peripheral surfaces of said rolls, motor means for rotating said rolls about their axes in opposite directions including a separate drive motor coupled to each of said rolls so that said transfer roll has a surface speed greater than the surface speed of said metering roll, an alarm means, and means for triggering said alarm means in response to the reaction torque on the drive motor for said metering roll when the amount of printing medium in said trough is below a predetermined amount.

2. Apparatus in accordance with claim 1 wherein said drive motor of said metering roll is mounted on a support for limited movement with respect to the axis of said metering roll and forms a part of said triggering means.

3. Apparatus in accordance with claim 2 wherein said triggering means includes an arm having one end connected to said motor support, said alarm means including a switch adjacent the other end of said arm, and means biasing said other end of said arm away from said switch.

4. Apparatus in accordance with claim 3 wherein said other end of said arm is bifurcated for receiving a limit stop to limit the extent of movement of said arm.

5. Printing apparatus comprising a frame, a rotatable printing roll, a rotatable transfer roll parallel to and having surface contact with said printing roll, a metering roll generally parallel to said transfer roll and cooperating with the transfer roll along its length to define a trough for receiving a liquid printing medium, each of said rolls being supported by said frame, first motor means coupled to said metering roll for rotating said metering roll about its longitudinal axis, second motor means coupled to said transfer roll for rotating said transfer roll about its longitudinal axis with a surface speed greater than the surface speed of said metering roll, an alarm means, and means coupled to said metering roll for triggering said alarm means when said metering roll is driven by said transfer roll due to depletion of the printing medium in said trough.

6. Apparatus in accordance with claim 5 wherein said triggering means is responsive to the reaction torque of said metering roll when the amount of printing medium in said trough is below a predetermined level.

7. Apparatus in accordance with claim 6 wherein said motor means coupled to said metering roll is supported for limited rotation about the longitudinal axis of said metering roll with respect to said frame.

8. Apparatus in accordance with claim 5 wherein said metering roll has a resilient surface and said transfer roll has an ink retaining surface.

9. Apparatus in accordance with claim 5 wherein said triggering means includes an arm having one end rigidly connected to first motor means, said alarm means including a switch adjacent the other end of said arm, and means biasing said other end of said arm away from said switch.

10. Apparatus in accordance with claim 9 wherein said other end of said arm is bifurcated for receiving a limit stop on said frame to limit the extent of movement of said arm.

* * * * *

UNITED STATES PATENT OFFICE

CERTIFICATE OF CORRECTION

PATENT NO. : 4,043,265

DATED : August 23, 1977

INVENTOR(S) : William Grobman

It is certified that error appears in the above-identified patent and that said Letters Patent are hereby corrected as shown below:

Title Page (73) Assignee: Molins Macine Company, Inc.

should read -- Molins Machine Company, Inc.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*